US005277611A

United States Patent [19]

Berek et al.

[11] Patent Number: 5,277,611

[45] Date of Patent: Jan. 11, 1994

[54] ARRANGEMENT FOR CONNECTING AN ELECTRICAL CONNECTOR TO A PRINTED CIRCUIT BOARD

[75] Inventors: Dennis W. Berek; Arvind Patel, both of Naperville; Daniel M. Prescott, Glen Ellyn, all of Ill.; Matthew Sanford, Lincoln, Nebr.

[73] Assignee: Molex Incorporated, Lisle, Ill.

[21] Appl. No.: 6,346

[22] Filed: Jan. 19, 1993

[51] Int. Cl.[5] ..... H01R 13/62

[52] U.S. Cl. ..... 439/325; 439/59; 439/359

[58] Field of Search ..... 439/59, 62, 325, 327, 439/359, 633, 636, 637, 680

[56] References Cited

U.S. PATENT DOCUMENTS

| | | | |
|---|---|---|---|
| 4,398,779 | 8/1983 | Ling | 439/64 |
| 4,406,511 | 9/1983 | Hayes . | |
| 4,715,820 | 12/1987 | Andrews, Jr. et al. | 439/59 |
| 4,738,625 | 4/1988 | Burton et al. | 439/59 |
| 4,995,814 | 2/1991 | Weidler | 439/65 X |

FOREIGN PATENT DOCUMENTS 2-78170 3/1990 Japan .

OTHER PUBLICATIONS

Molex Part No. 2574 "Molex Catalog, p. 23F, 1991".

*Primary Examiner*—Neil Abrams
*Assistant Examiner*—Khiem Nguyen
*Attorney, Agent, or Firm*—Stephen Z. Weiss

[57] ABSTRACT

An arrangement is provided for connecting an electrical connector to a mating printed circuit board. The connector includes a dielectric housing having top and bottom walls joined by spaced apart side walls. An elongated slot is defined by the top and bottom walls for receiving the mating printed circuit board. A plurality of terminals are mounted in the housing with contact portions along the slot for engaging contact pads on the circuit board. At least one pair of aligned apertures pass through the top and bottom walls of the housing, and an aperture in the circuit board is adapted for alignment with the housing apertures when the circuit board is inserted into the slot. A fastener is received in the housing apertures and the aligned board aperture to maintain the board in mating relationship with the connector. The fastener is adapted to clamp against the top and bottom walls of the housing. The width of the slot is greater than the thickness of the printed circuit board to allow the board to float relative to the fastener, whereby the clamping forces of the fastener against the top and bottom walls of the housing are not transmitted to the printed circuit board.

2 Claims, 3 Drawing Sheets

ARRANGEMENT FOR CONNECTING AN ELECTRICAL CONNECTOR TO A PRINTED CIRCUIT BOARD

FIELD OF THE INVENTION

This invention generally relates to the art of electrical connectors and, particularly, to an arrangement for connecting an electrical connector assembly to an edge of a mating printed circuit board.

BACKGROUND OF THE INVENTION

There are a wide variety of electrical connector assemblies which are arranged for mating with a printed circuit board. One type of such a connector is arranged or adapted for connecting to the board at an edge thereof. These connectors often are called "edge card" connectors. Within this category of connectors, there also are a wide variety of edge card connector arrangements. It should be understood that some edge card connector arrangements equally are adapted for receiving and/or connecting a mating flat cable which includes a plurality of discrete conductor wires embedded in a flat substrate of insulating material.

Electrical connector arrangements of the character described above often include an slot formed in a side of the connector housing. In the case of a printed circuit board, the slot may receive a tongue portion projecting from the edge of the board. In the case of a flat cable, the slot may receive a distal end of the cable. Many such connectors also include fastening means, such as elongated screws or bolts, for mounting the connector housing to a chassis or a second printed circuit board. It would be desirable to employ this same fastening means for interconnecting or locking the board/cable to the electrical connector.

In most such electrical connectors which have elongated slots for receiving an edge portion or end of a board or cable, a plurality of terminals are mounted in the housing along the slot, and spring contact portions of the terminals are biased against contact pads on a side of the printed circuit board, for instance. Many such connectors rigidly clamp the board within the slot against movement perpendicular to the plane of the board. This creates problems in the spring contact portions of the terminals developing a "set" over time, whereupon the spring contact portions lose their resiliency and their effective biased engagement with the pads on the circuit board. In addition, problems are encountered in developing stresses in the areas around the fastening means which interconnect or lock the board to the connector housing. This invention is directed to an arrangement for solving these types of problems.

SUMMARY OF THE INVENTION

An object, therefore, of the invention is to provide a new and improved arrangement for connecting an electrical connector to a mating printed circuit board, such as at an edge of the board.

In the exemplary embodiment of the invention, the electrical connector includes a dielectric housing having top and bottom walls joined by spaced apart side walls, with means defining an elongated slot between the top and bottom walls for receiving the mating printed circuit board. A plurality of terminals are mounted in the housing with contact portions along the slot for engaging contact pads on the circuit board.

The invention contemplates an arrangement of at least one pair of aligned apertures passing through the top and bottom walls of the connector housing. An aperture is provided in the circuit board adapted for alignment with the apertures in the housing when the circuit board is inserted into the slot. A fastener is adapted to be received in the housing apertures and the aligned board aperture to maintain the board in mating relationship with the connector. The fastener is adapted to clamp against the top and bottom walls of the housing and also can be used to mount the housing to a chassis or another printed circuit board. The width of the slot is greater than the thickness of the printed circuit board so that the clamping forces of the fastener against the top and bottom walls of the housing are not transmitted to the printed circuit board. In other words, the circuit board can float relative to the fastener.

Preferably, the apertures in the top and bottom walls of the housing are located adjacent one of the end walls thereof, whereby the end wall provides reinforcement against the clamping forces of the fastener.

As disclosed in the preferred embodiment of the invention, two pairs of the aligned apertures in the top and bottom walls of the housing are located in wing portions of the housing outside the end walls defining the slot. A pair of corresponding apertures are provided in the printed circuit board for respective alignment with the two pairs of housing apertures. A pair of fasteners are adapted to be respectively received in the pairs of housing apertures and the respective aligned board apertures. Each pair of aligned apertures in the top and bottom walls of the housing is located adjacent a respective one of the end walls, whereby the end walls provide reinforcement against the clamping forces on the housing. The printed circuit board includes a tongue portion insertable into the slot, along with a pair of end wing portions having apertures therein alignable with the two pairs of housing apertures. The end wing portions of the board are located outside the end walls and separated from the tongue portion by an notch. This isolates the areas of stress about the fasteners from the interengagement between the board contact pads and the terminal contact portions.

In an alternate embodiment of the invention, the slot means for receiving the printed circuit board is located between the top and bottom walls of the connector, with terminals located along both sides of the slot for engaging contact pads on both sides of the printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
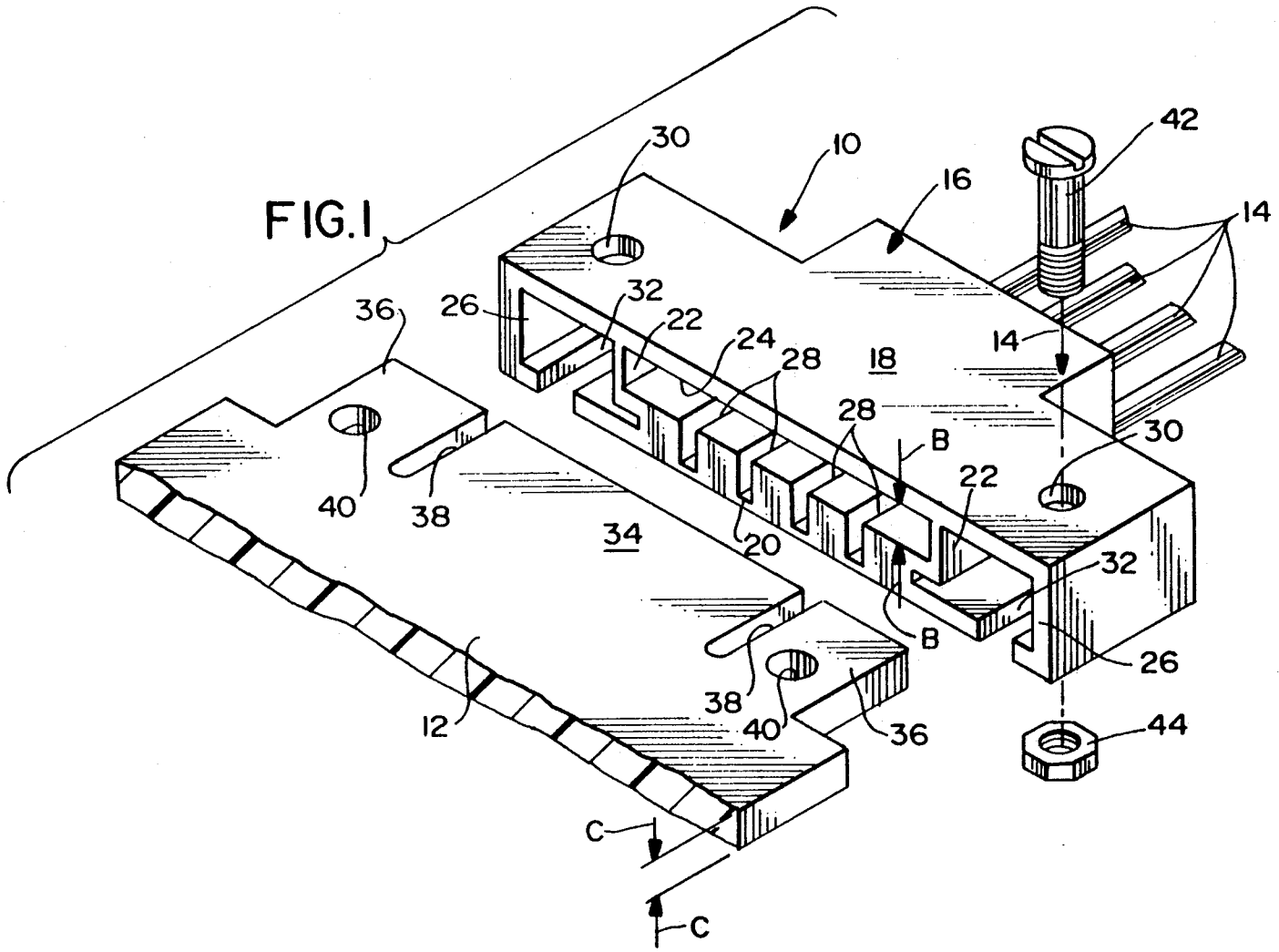
FIG. 1 is an exploded perspective view of the arrangement of the invention for connecting an electrical connector to a mated printed circuit board.

Referring to the drawings in greater detail, and first to FIG. 1, the invention is incorporated in an arrangement for connecting an electrical connector, generally designated 10, to a mating printed circuit board 12. The connector mounts a plurality of terminals not visible in FIG. 1 but which are described hereinafter in relation to FIG. 5. The terminals are terminated to a plurality of wires or conductors 14.

Electrical connector 10 includes an insulating housing, generally designated 16, which is unitarily molded of dielectric material, such as plastic or the like. The housing includes a top wall 18, a bottom wall 20, with the top and bottom walls being joined by a pair of spaced apart side walls 22 defining an elongated slot 24. A pair of end walls 26 also join top and bottom walls 18 and 20, outside end walls 22 and slot 24, to effectively form wing portions of the connector housing outside the slot. Bottom wall 20 is provided with a plurality of terminal-receiving channels 28 for receiving a plurality of terminals along slot 24, as described hereinafter. Lastly, connector housing 16 includes two pairs of aligned apertures 30 and 32 in top wall 18 and bottom wall 20, respectively. It can be seen that the apertures are adjacent side walls 22, and between the side walls and end walls 26 outside slot 24. Apertures 32 actually are in the form of notches. The side and end walls provide reinforcement for isolating the contact areas of the printed circuit board from clamping forces of fastening means, as described in greater detail hereinafter.

Printed circuit board 12 includes a central tongue portion 34 and a pair of wing portions 36 separated from the tongue portion by a pair of notches 38. Tongue portion 34 is sized for insertion into slot 24 in connector housing 16, and wing portions 36, separated from the tongue portion, are insertable into the outside wing portions of the housing between side walls 22 and end walls 26. A pair of apertures 40 are provided in printed circuit board 12, particularly in wing portions 36 of the board, for alignment with the two pairs of apertures 30 and 32 in connector housing 16 when the printed circuit board is assembled to the housing, i.e. when tongue portion 34 is inserted into slot 24 of the housing. Although not visible in FIG. 1, the bottom side of circuit board 12 is provided with a plurality of contact pads for engaging contact portions of the terminals mounted in the connector housing, as described hereinafter.

A pair of fasteners, in the form of bolts 42, are adapted to be received in housing apertures 30 and 32 and board apertures 40 to maintain or lock the board in mating relationship with connector 10. Only one fastener 42 is shown in FIG. 1 and the fastener is inserted into the aligned housing and board apertures in the direction of arrow "A". A nut 44 is threadable onto the distal end of bolt 42 to clamp against the top and bottom walls 18 and 20, respectively, of connector housing 16. As will be understood more clearly hereinafter, the width of slot 24, as indicated by arrows "B" is at least slightly greater than the thickness of printed circuit board 12 as indicated by arrows "C". Therefore, the board can float longitudinally of fasteners 42 so that the clamping forces of the fasteners against the top and bottom walls of the housing are not transmitted to the printed circuit board. In addition, by locating apertures 40 in wing portions 36 of the circuit board, with the wing portions isolated from tongue portion 34 of the board by notches 38, the fastening areas of the board are isolated from the contact areas of the board which, thereby, isolates the stress areas about the fasteners from the contact areas on the tongue portion of the board.

Figure 2:
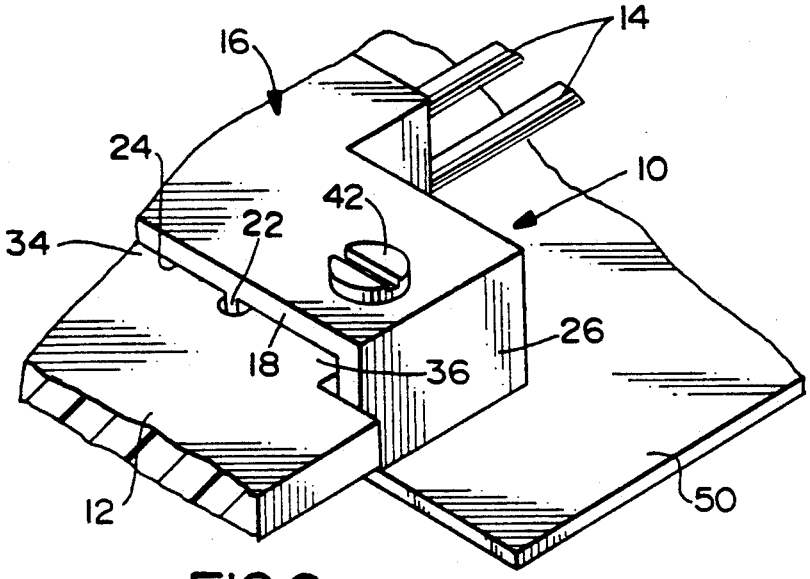
FIG. 2 is a fragmented perspective view of the right-hand end of FIG. 1, with the printed circuit board mated to the connector, and the connector fastened to a second printed circuit board.
Figure 4:
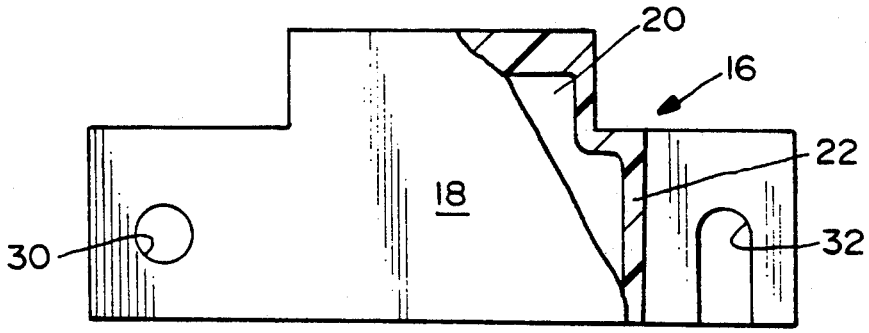
FIG. 4 is a fragmented top plan view of the connector housing.

FIG. 2 shows printed circuit board 12 in mated condition with respect to connector 10. Specifically, it can be seen that tongue portion 34 of the board has been inserted into slot 24, and one of the wing portions 36 of the board has been inserted into one of the wing portions of the connector housing between side wall 22 and end wall 26. One of the fasteners 42 has been inserted through the housing apertures and the board aperture to maintain or lock the board in its mating relationship with the connector, as seen in FIG. 2. FIG. 2 also shows that fasteners 42 have been employed to securely mount the connector to a planar substrate 50. This substrate may be a chassis of appropriate electronic equipment or it may be a second printed circuit board. Regardless, as described above, all of the clamping forces of fasteners 42, for securely clamping connector housing 16 to the substrate, are isolated from printed circuit board 12.

Figure 3:
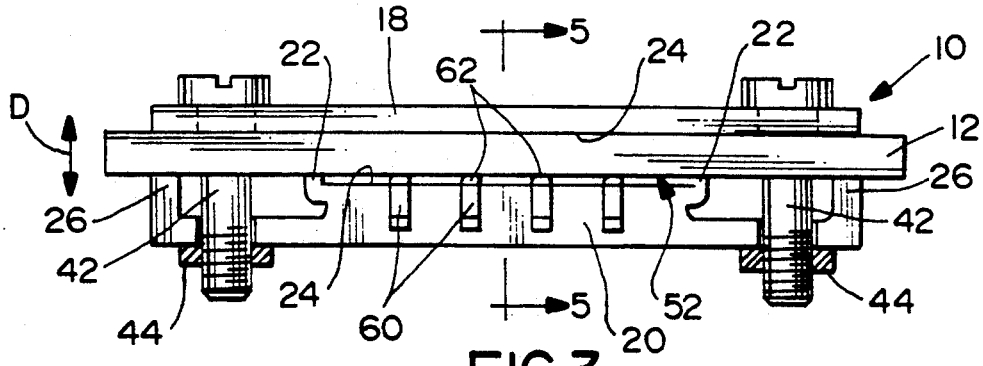
FIG. 3 is a front elevational view of the connector and board.

FIG. 3 shows a front elevational view of printed circuit board 12 assembled or mated with connector 10, and this depiction is provided primarily for illustrating that slot 24 in connector housing 16 is at least slightly wider than the thickness of the printed circuit board, to define a space 52 between the housing bottom wall 20 and the bottom of the board. The board is biased upwardly against top wall 18 by spring contact portions of the terminals, as described hereinafter. Therefore, printed circuit board 12 can float longitudinally of fasteners 42 in the direction of double-headed arrow "D". In other words, when fasteners 42,44 are clamped against the top and bottom of the connector housing (substrate 50 not being shown in FIG. 3), the clamping forces of the fasteners are not transmitted to the printed circuit board.

Figure 5:
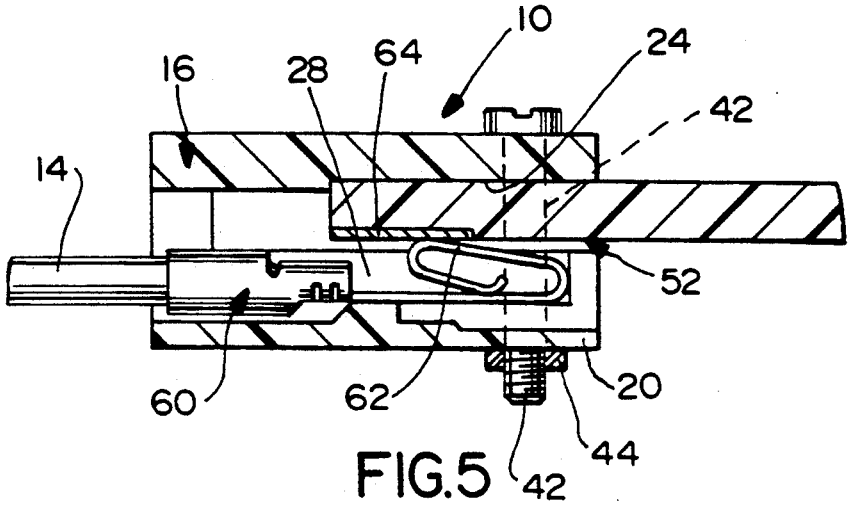
FIG. 5 is a vertical section, on an enlarged scale, taken generally along line 5—5 of FIG. 3.

FIG. 5 shows one of the conductors 14 terminated to a terminal, generally designated 60, the terminal having a spring contact portion 62 which is biased upwardly against a contact pad 64 on the bottom of printed circuit board 12. It should be understood that one of the terminals 60 is located in each channel 28 (FIG. 1) formed in bottom wall 20 of connector housing 16. The combined biasing forces of the terminal contact portions 62 effectively bias the circuit board upwardly within slot 24, leaving space 52 between the board and the slot.

Not only does the floating action of the printed circuit board effectively isolate the clamping forces of fasteners 42 from the board, but another advantage is that "spring sets" are prevented from developing in spring contact portions 62 of terminals 60. More particularly, it is known that any spring component, particularly a thin spring component like spring contact portions 62, will establish a set if the spring component remains in a fixed position over time. When a spring component develops a set, it inherently loses a considerable amount of its resiliency. In electrical contact applications, a loss of resiliency in the spring contact portions will reduce positive electrical interengagement between the terminals and the contact pads on the printed circuit board. According to the invention, the printed circuit board is allowed to float within the connector, to allow some flexing of spring contact portions 62 whereupon the spring contact portions will not establish a spring set and lose their resiliency.

Figure 6:
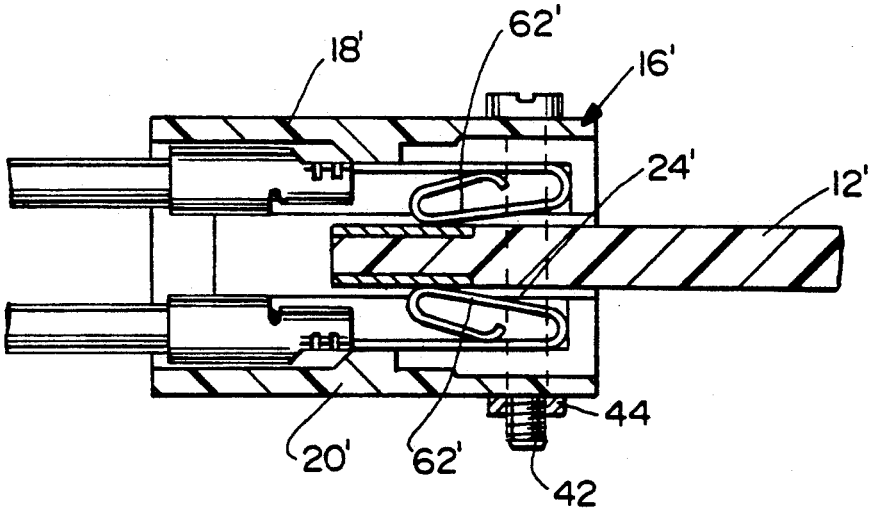
FIG. 6 is a view similar to that of FIG. 5, but of an alternate embodiment of the invention including terminals for interengagement with contact pads on both sides of the printed circuit board.

Lastly, FIG. 6 shows an alternate embodiment of the invention, wherein a connector housing, generally designated 16', includes a top wall 18'and a bottom wall 20' against which the forces of a fastener 42,44 is clamped. In this embodiment, slot means 24' are defined between the top and bottom walls. In addition, this embodiment shows a pair of terminals mounted within the housing on opposite sides of a printed circuit board 12', along with spring contact portions 62' of the terminals adapted for engaging contact pads on both sides of the circuit board. Again, with the alternate form of the invention shown in FIG. 6, the width of slot means 24' is at least slightly greater than the thickness of printed circuit board 12' so that the clamping forces of fasteners 42,44 against top and bottom walls 18' and 20', respectively, are not transmitted to the printed circuit board as the board is allowed to float longitudinally of the fasteners.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an arrangement for connecting an electrical connector to a mating printed circuit board, the connector including a dielectric housing having top and bottom walls joined by spaced apart side walls, means defining an elongated slot between the top and bottom walls for receiving the mating printed circuit board, and a plurality of terminals mounted in the housing with contact portions along the slot for engaging contact pads on the circuit board, wherein the improvement comprises at least one pair of aligned apertures passing through the top and bottom walls of the housing, an aperture in the circuit board adapted for alignment with the apertures in the housing when the circuit board is inserted into the slot, and a fastener adapted to be received in the housing apertures and the aligned board aperture to maintain the board in mating relationship with the connector, the fastener being adapted to clamp against the top and bottom walls of the housing, and the width of the slot being greater than the thickness of the printed circuit board so that clamping forces of the fastener against the top and bottom walls of the housing are not transmitted to the printed circuit board, said housing apertures being located in a wing portion of the housing located outside one of said side walls and said printed circuit board including a tongue portion insertable into slot and an end wing portion having the board aperture therein, the end wing portion being located outside the one side wall and separated from the tongue portion by a notch.

2. In an arrangement for connecting an electrical connector to a mating printed circuit board, the connector including a dielectric housing having top and bottom walls joined by spaced apart side walls, means defining an elongated slot between the top and bottom walls for receiving the mating printed circuit board, and a plurality of terminals mounted in the housing with contact portions along the slot for engaging contact pads on the circuit board, wherein the improvement comprises two pairs of aligned apertures passing through the top and bottom walls of the housing near opposite ends of the slot, a pair of apertures in the circuit board adapted for alignment with the two pairs of apertures in the housing when the circuit board is inserted into the slot, and a pair of fasteners adapted to be respectively received in the pairs of housing apertures and the respective aligned board apertures to maintain the board in mating relationship with the connector, the fastener being adapted to clamp against the top and bottom walls of the housing, and the width of the slot being greater than the thickness of the printed circuit board so that clamping forces of the fastener against the top and bottom walls of the housing are not transmitted to the printed circuit board, each pair of apertures in the top and bottom walls of the housing being located adjacent and outside a respective one of said side walls in the wing portions whereby the side walls provide reinforcement against the clamping forces of the fasteners, and the printed circuit board including a tongue portion insertable into said slot and a pair of end wing portions having apertures therein, the end wing portions being located outside the side walls and separated from the tongue portion by notches.

* * * * *